United States Patent [19]

Bose

[11] 4,370,223

[45] Jan. 25, 1983

[54] COKING HYDROCARBONACEOUS OILS WITH AN AQUEOUS LIQUID

[75] Inventor: Phillip R. Bose, Pleasant Hill, Calif.

[73] Assignee: Chevron Research Company, San Francisco, Calif.

[21] Appl. No.: 324,216

[22] Filed: Nov. 24, 1981

Related U.S. Application Data

[63] Continuation-in-part of Ser. No. 221,758, Dec. 31, 1980, abandoned.

[51] Int. Cl.[3] ..... C10G 9/26

[52] U.S. Cl. ..... 208/125; 208/7; 208/130

[58] Field of Search ..... 208/130, 7, 125

[56] References Cited

U.S. PATENT DOCUMENTS

| | | | |
|---|---|---|---|
| 2,413,407 | 12/1946 | Dreyfus | 208/130 |
| 3,213,015 | 10/1965 | Atkinson et al. | 208/130 |
| 3,238,116 | 3/1966 | Hammer et al. | 208/7 |
| 3,261,878 | 7/1966 | Danz et al. | 208/7 |
| 3,824,084 | 7/1974 | Dillon et al. | 44/1 R |
| 3,876,497 | 4/1975 | Hoffman | 162/189 |
| 3,912,626 | 10/1975 | Ely | 210/50 |
| 4,013,560 | 3/1977 | Pradt | 210/152 |
| 4,100,730 | 7/1978 | Pradt | 60/39.05 |
| 4,174,280 | 11/1979 | Pradt et al. | 210/60 |
| 4,174,953 | 11/1979 | Sun et al. | 44/1 R |
| 4,197,090 | 4/1980 | Yoo et al. | 44/1 SR |
| 4,211,174 | 7/1980 | Martin et al. | 110/263 |

OTHER PUBLICATIONS

Mechanical Eng., Dec. 1979, pp. 30-37.

AICHE Symposium Series, vol. 76, No. 192, p. 51.

*Primary Examiner*—Curtis R. Davis

*Attorney, Agent, or Firm*—D. A. Newell; S. R. LaPaglia; C. L. Hartman

[57] ABSTRACT

A process for forming coke from an oil is disclosed, in which the oil is contacted with liquid-phase water and free oxygen at an elevated temperature and a pressure sufficient to maintain at least part of the water in the liquid phase.

5 Claims, 1 Drawing Figure

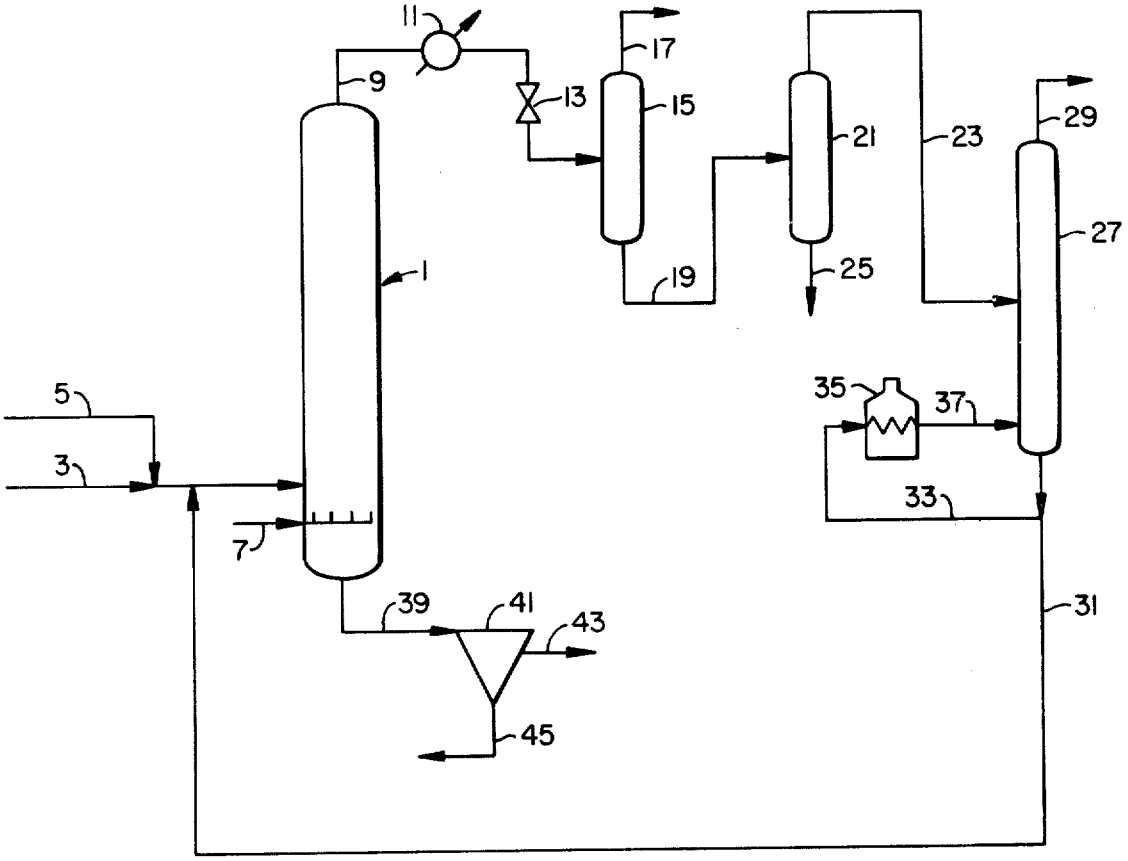
11
17
9
13
15
21
23
29
27
1
19
25
5
35
37
3
33
7
39
41
43
31
45

COKING HYDROCARBONACEOUS OILS WITH AN AQUEOUS LIQUID

CROSS-REFERENCE TO RELATED APPLICATIONS

This application is a continuation-in-part of application Ser. No. 221,758, filed Dec. 31, 1980, entitled "Coking Hydrocarbonaceous Oils with an Aqueous Liquid" now abandoned.

BACKGROUND OF THE INVENTION

The present invention concerns a process for producing coke and hydrocarbon distillate from hydrocarbonaceous oils. More specifically, the invention concerns a process for converting a heavy oil to provide a valuable liquid distillate and a high-purity coke by contacting the heavy oil with free oxygen and liquid phase water at an elevated temperature and pressure.

Heavy petroleum crude oils and heavy oil fractions such as residua may be used as low-grade commercial fuels. Heavy oils may also be converted to more valuable products by thermal or catalytic conversion processing. Such conventional conversion processes as delayed coking, fluid bed coking, catalytic cracking and hydrogen treating, with or without a catalyst, have been suggested for conversion of heavy oils. Heavy crudes and oil fractions often contain substantial concentrations of detrimental contaminants, including organic nitrogen and sulfur compounds, metals (especially nickel and vanadium), coke precursors (e.g., asphaltenes), and the like. When heavy oils are burned directly as fuel, the presence of metals, nitrogen and sulfur can result in contamination of flue gas with objectionable air pollutants including particulates, nitrogen oxides and sulfur oxides. In attempting to upgrade heavy oils by conventional catalytic processes, the presence in the oils of nitrogen, sulfur, and particularly nickel and vanadium, results in rapid deactivation of catalysts, and can cause catalytic upgrading of residual oils to be a less than completely satisfactory upgrading method.

When heavy crudes and oil fractions are subjected to conventional pyrolysis-type coking (e.g., delayed or fluid coking) at temperatures of 350° C. to 500° C., large concentrations of heat-sensitive, coke-forming materials, such as asphaltenes, can result in relatively low yields of the more valuable primary product, distillates, and relatively high yields of the less valuable by-product, coke. The presence of undesirably large concentrations of contaminants in coke derived by conventional coking of heavy oils detracts from the value of coke as a by-product. This is particularly true for sulfur. The quality of coke obtained from heavy oil high in contaminants may thus make it unsuitable for some uses, e.g., electrodes, because of poor specifications of such properties as coefficient of thermal expansion, electrical resistivity and sulfur content.

A general discussion of wet air oxidation technology, found in *Mechanical Engineering*, December 1979, page 30, is incorporated herein by specific reference. A discussion of regeneration of active carbon, after use in waste water treating, by means of wet air oxidation, found in AICHE Symposium Series, Vol. 76, No. 192, (Recent Advances in Separation Technology-II), Page 51, (AICHE, 1980), is incorporated herein by specific reference.

A process for removing pyritic sulfur from coal, by treatment with water and air at elevated temperature and pressure to convert the pyritic sulfur to water-soluble ferrous and ferric sulfate, is disclosed in U.S. Pat. No. 3,824,084. Use of silicates and an oxidizing agent (such as air, oxygen, hydrogen peroxide, alkali metal sulfides, alkaline earth metal sulfides) or a reducing agent (such as $H_2$, CO, $K_2$, $S_2O_4$, $NaS_2O_4$, and alkali metal polythionates) in an aqueous medium to desulfurize coal is disclosed in U.S. Pat. Nos. 4,174,953 and 4,197,090.

Use of wet air oxidation to provide heat energy in the form of steam, as by wet air oxidation of coal, is disclosed in U.S. Pat. Nos. 4,211,174, 4,100,730, and 4,013,560.

Use of copper or silver ions to catalyze wet air oxidation of organic material in waste water is disclosed in U.S. Pat. No. 3,912,626.

Treatment of papermill waste sludges by wet air oxidation to convert organic components to innocuous oxidation products and to provide for recovery of inorganic filter materials for reuse, is disclosed in U.S. Pat. No. 3,876,497.

Essentially complete oxidation of solid or liquid combustible materials which are difficult to suspend in water, such as diesel fuel and nitroglycerine, by direct injection into a wet air oxidation reactor, is disclosed in U.S. Pat. No. 4,174,280.

None of the publications concerning wet air oxidation is concerned with forming coke and distillate liquid from a hydrocarbonaceous oil. Hydrocarbonaceous materials which are utilized in the disclosed wet air oxidation systems are simply consumed to form highly oxidized waste materials, primarily carbon dioxide and water.

SUMMARY OF THE INVENTION

In an embodiment, the present invention concerns a process for producing coke from a hydrocarbonaceous oil, which comprises forming coke by contacting the oil with free oxygen in the presence of an aqueous liquid at a temperature of at least 300° C. and a pressure sufficient to maintain the aqueous liquid at least partially in the liquid phase.

I have found that high-quality coke can be formed from a heavy hydrocarbonaceous oil by contact with liquid phase water and free oxygen at elevated temperature and pressure. The amounts of such contaminants as metals and sulfur in the resulting coke are advantageously low, and a desirable, low yield of coke, relative to distillable hydrocarbons, is obtained. Advantageously, the coke formation can be carried out in a continuous manner, eliminating the need for removal of coke from drums, as is done in delayed coking. Heat requirements for the present process can be provided completely by oxidation of heavy oil in the system.

DESCRIPTION OF THE DRAWING

The attached drawing is a schematic representation of a preferred embodiment of the present invention.

Referring to the drawing, there is shown a wet air oxidation reactor 1. Aqueous liquid, which may include fresh water, recycle water, or both, is introduced into the system through a conduit 3. A feed stream of heavy hydrocarbonaceous oil to be converted is introduced to the system through a conduit 5 and is mixed with the aqueous phase in the conduit 3. Free oxygen-containing gas is introduced into the system through a conduit 7 and is passed into the lower portion of the reactor 1.

The oil-water mixture in the conduit 3 is passed into the reactor 1 above the oxygen inlet. In the reactor, the mixture is maintained at suitable reaction conditions including an elevated temperature above 300° C., such as about 375° C., and a pressure sufficient to maintain the aqueous phase as a liquid such as 70 atmospheres. The liquids and gases flow upwardly through the reactor and are removed from the top of the reactor through a conduit 9. The mixture is then cooled in a heat exchanger 11, and is passed through a pressure reducing valve 13. The mixture is then charged to a gas separator vessel 15, in which gases in the mixture are separated from the liquids. Gases are removed from the top of the gas separator vessel and withdrawn from the system through a conduit 17. The mixture of aqueous and hydrocarbonaceous liquid phases is then passed from the vessel 15 through a conduit 19 into phase separation means, such as a settling vessel 21. The generally lighter oil phase rises to the top of the vessel 21 and is withdrawn by means of a conduit 23. Aqueous liquid settles to the bottom of the vessel 21 and is withdrawn through a conduit 25. The hydrocarbonaceous liquid is passed from the conduit 23 into a fractionator vessel 27. Lower-boiling, more valuable product hydrocarbons are vaporized, withdrawn overhead through a conduit 29, and recovered. Higher-boiling, less valuable components of the oil are withdrawn from the bottom of the fractionator and recycled to the feed conduit 3 by way of a conduit 31. A reboiling slip stream from the liquid effluent in the conduit 31 is removed into a conduit 33, heated in a furnace 35, and returned to the fractionator through a conduit 37. Referring again to the reactor vessel 1, reactions occur in the vessel which form solid coke particles. The coke particles sink to the bottom of the vessel, and are withdrawn as a slurry in aqueous liquid through a conduit 39. Coke is separated from most of the aqueous liquid in a centrifuge 41 and is withdrawn from the system as a concentrated aqueous slurry by way of a conduit 43. Aqueous liquid is withdrawn from the centrifuge through a conduit 45. The aqueous streams in conduits 25 and 45 may, if desired, be recycled directly to the reactor 1, or may be mixed with fresh water in the conduit 5 or hydrocarbon feed in the conduit 3. The water recycle streams may be treated, as for removal of solids, mineral salts, and the like (by means not shown) prior to recycle, if desired. Various conventional elements necessary for carrying out the embodiment depicted in the drawing, such as control means, pumping means, compressing means, and the like, are not shown or discussed. The disposition and use of such conventional elements will be apparent to those skilled in the art.

DETAILED DESCRIPTION OF THE INVENTION

A wide variety of hydrocarbonaceous oils may be converted by the process of this invention to provide coke and distillate oil. Preferred feed oils are those which contain an objectionable amount of one or more undesirable contaminants. For example, an oil containing an undesirable concentration of one or more metalliferous contaminants can be treated to provide coke and distillate having a low metals concentration. An oil containing an undesirably high concentration of one or more sulfurous contaminants can be treated to provide coke and distillate having a low sulfur concentration. An oil containing an undesirably high concentration of one or more nitrogeneous contaminants can be treated to provide coke and distillate having a low nitrogen concentration. Oils having an undesirably high concentration of asphaltenes can be treated to provide a high yield of distillate product and a high-quality coke in relatively low yield. Oils having a viscosity which is above the desired viscosity can be treated to provide coke and a distillate having a desirably low viscosity. Oils containing an undesirably high concentration of relatively higher molecular weight hydrocarbons can be treated according to the invention to provide a small yield of high-quality coke and a distillate oil having a low concentration of higher molecular weight hydrocarbons and a high concentration of lower molecular weight hydrocarbons. For example, high molecular weight, nondistillable compounds, such as asphaltenes, can be converted to distillable hydrocarbon compounds and lower molecular weight compounds during the coking step of the present invention.

Although any oil can be used as a feed, preferred feeds are those contaminated with one or more of the contaminants discussed above or having an overly high boiling range or overly high viscosity. Particularly preferred feed oils are petroleum residuals, heavy petroleum crudes, shale oils, coal oils, tar sand oils (bitumens), and analogous natural and synthetic oils and oil fractions, and mixtures thereof. For example, particularly preferred feeds include such petroleum fractions as atmospheric distillation bottoms streams, vacuum distillation bottoms streams, catalytic cracking product fractionator bottoms and slurry oils, and, in general, residual fractions of petroleum, coal-derived oil, tar sand bitumen, shale-derived oil, or the like, a substantial fraction of which has a boiling range above 565° C. Particularly preferred heavy crude petroleum or tar sand oils for upgrading are those with one or more of the following properties: an API gravity of less than 20°; a Ramsbottom carbon residue factor of greater than 5%; an asphaltenes fraction (which may be defined as the n-heptane insoluble fraction) of greater than 3 weight percent; or oil in which a fraction greater than 10 weight percent has a normal boiling range above 565° C. Preferred feeds include bitumen derived from tar sands, or bituminous sands, and tars such as those found in the Athabasca region of Canada and the Orinoco region of Venezuela.

Preferred feed oils include oils having a substantial concentration of at least one metal selected from nickel and vanadium. These metals are usually present in the oils in the form of organometallic compounds, such as metalloporphyrins.

Preferred feed oils include oils having a substantial concentration of finely divided solid contaminants. Solid contaminants may be solid carbonaceous organic material, solid inorganic material, or both. Examples of solids found in some preferred feed oils are clay, sand, silt and salts, as alkaline earth metal carbonates and silicates.

The aqueous liquid used in the coking process of the present invention may simply be water or may be an aqueous solution or suspension of one or more inorganic or organic compounds or ions. In some cases, addition of soluble or suspended materials can be beneficial to carrying out the process, as, for example, in cases where the added material can catalyze reactions which take place in forming relatively large yields of high-quality distillate, high-quality coke, or both. Preferred additive materials include alkali metals, alkaline earth metals, their ions and salts. Added catalytic or noncatalytic materials such as alkali and alkaline earth metals can optionally be mixed with the feed oil or the free oxygen-containing gas prior to contacting the gas, water and oil at high temperatures, but additives are preferably premixed with the aqueous phase.

The temperature at which the present process is carried out is a temperature sufficient to form coke from the feed oil. The temperature should usually be maintained above about 300° C. Preferably, the reaction temperature is maintained between about 315° C. and 540° C. Especially preferably, the reaction temperature is maintained in the range from about 325° C. to about 425° C. The elevated temperature can advantageously be achieved solely by oxidation reactions which occur after the oil, aqueous liquid and free oxygen are contacted. Heat can also be provided by preheating one or more of the components prior to contact with the other components. Often, heat exchange between the hot liquid-phase effluent from the reaction zone and one or more of the aqueous, oil or free oxygen feed streams is advantageous in conserving heat energy.

It will be apparent that the conversion temperature may vary considerably with time in carrying out some embodiments of the process, in that oxidation reactions will tend to increase the temperature of the reaction mixture over the extent of the contact time until the free oxygen is consumed. Thus, in a batch-type reaction, the reaction mixture may start at a very low temperature, e.g., below 300° C., and rise to a high level, which may even be above 540° C., by the end of the contact time. A similar increasing temperature profile may be observed when a plug flow-type contacting scheme is employed. In general, however, the reaction mixture is preferably maintained at a temperature within the indicated suitable temperature range for at least a major portion of the contact time. The contact time is suitably adjusted to give optimum production of the desired product or products, i.e., distillate and/or coke.

The pressure employed in the present process is at least sufficient to maintain at least a portion of the water in the aqueous phase as a liquid. Preferably, a pressure is employed which is at least sufficient to maintain the major portion of the water in the aqueous phase as a liquid. Higher pressures have the advantage of permitting relatively larger amounts of free oxygen to be dissolved and dispersed in the liquid aqueous phase, but increased capital and operating costs involved in carrying out higher pressure operations usually set a practical limit on the maximum pressure that can economically be used.

According to the invention, free oxygen, i.e., molecular or atomic oxygen, or a precursor thereof, is contacted with oil and an aqueous liquid. To supply the oxygen component for the process, pure molecular oxygen gas ($O_2$ or $O_3$) can be used. Air and other gaseous mixtures which contain molecular oxygen mixed with one or more diluent gases, such as nitrogen, steam, carbon dioxide, etc., are also suitable. Solid, liquid or gaseous compounds of combined oxygen, which decompose or react to form atomic or molecular oxygen at the temperatures and pressures used in the present process, such as hydrogen peroxide, may be used to supply the free oxygen component. The free oxygen component, or a precursor thereof, can be mixed with the aqueous liquid prior to, simultaneously with, or after contact is established between the aqueous liquid and the feed oil. The amount of free oxygen employed relative to the amount of oil should be sufficient to react with not more than a minor portion of the oil. Preferably, less than 30 weight percent free oxygen, relative to the weight of oil, should be used.

Contact of the feed oil with aqueous liquid and with free oxygen can be carried out in a suitable conventional reactor or other suitable conventional vessel or container means, which should be sufficiently resistant to the temperatures, pressures, corrosive compounds and other reaction conditions which are encountered in carrying out the present invention. Coke formation can be carried out in a batch-type system, or particularly preferably, in a continuous-type system. The oil, water and free oxygen components can be contacted in cocurrent flow, in countercurrent flow, in a stirred tank-type system or other suitable contacting system. Preferably, contact is accomplished with cocurrent flow of oil, water and oxygen through a reaction zone, preferably in upflow through a vertically-extending vessel. Preferably, at least a portion of the free oxygen employed is introduced into contact with the aqueous liquid after contact is established between the aqueous liquid and the oil.

Preferably, oil and aqueous liquid are contacted at an aqueous liquid:oil volume ratio in the range from about 0.5:1 to about 10:1. Particularly preferably, an aqueous liquid:oil volume ratio of about 1:1 to about 4:1 is used.

As a by-product of forming coke and distillate from the feed oil, it may be advantageous to generate steam from a portion of the aqueous liquid with heat formed by oxidation, and the steam can be used to supply energy for electrical power regeneration, and the like. It should be noted, however, that at least a portion of the aqueous phase will preferably remain as a liquid at the end of the contacting period.

It may be advantageous to recover such metals as nickel and vanadium from the aqueous liquid after the coking step, and this can be accomplished by solvent extraction or other conventional means.

EXAMPLE

An atmospheric distillation residual oil fraction was coked according to the present invention in a bench scale test. The temperature employed was 371° C. The pressure employed was 67 atmospheres. Oil was fed at a rate of 80 cc per hour. The feed was an Arabian Heavy atmospheric residual fraction containing 3.4 weight percent sulfur, 0.31 weight percent nitrogen, with a carbon content of 84.5 weight percent and a hydrogen content of 11.0 weight percent. The test was performed in a cocurrent, upflow system in a simple reactor vessel. The coke formed in the reactor was analyzed and found to contain 4.9 weight percent sulfur, 0.46 to 0.49 weight percent nitrogen, 73.6 weight percent carbon and 4.3 weight percent hydrogen. It had a heat of combustion of 12,613 BTU/pound (293,000 kJ/kg).

What is claimed is:

1. A process for producing coke from a hydrocarbonaceous oil which comprises:

forming coke by contacting said oil with free oxygen in the presence of an aqueous liquid at a temperature of at least 300° C. and a pressure sufficient to maintain said aqueous liquid at least partially in the liquid phase.

2. A process as defined in claim 1 wherein said contacting is carried out at a temperature between 315° C. and 540° C.

3. A process as defined in claim 1 wherein steam is recovered as a by-product.

4. A process as defined in claim 1 wherein at least two of said hydrocarbonaceous oil, said aqueous liquid and said free oxygen are mixed together at a temperature below about 300° C. and the temperature of the resulting mixture is increased to greater than 300° C. at least in part by heat energy supplied by reaction of at least a portion of said free oxygen with a portion of said hydrocarbonaceous oil.

5. A process as defined in claim 1 wherein at least a portion of said free oxygen is contacted with said hydrocarbonaceous oil and said aqueous liquid after said oil and said aqueous liquid have been mixed together.

* * * * *